US010131518B2

(12) United States Patent
Vuorenala et al.

(10) Patent No.: US 10,131,518 B2
(45) Date of Patent: Nov. 20, 2018

(54) SIGNALING ELEVATOR ALLOCATION BASED ON TRAFFIC DATA

(71) Applicant: KONE CORPORATION, Helsinki (FI)

(72) Inventors: Jere Vuorenala, Hyvinkää (FI); Niko Elomaa, Hyvinkää (FI); Tuomas Susi, Helsinki (FI); Johan Grönholm, Espoo (FI)

(73) Assignee: KONE CORPORATION, Helsinki (FI)

( * ) Notice: Subject to any disclaimer, the term of this patent is extended or adjusted under 35 U.S.C. 154(b) by 396 days.

(21) Appl. No.: 14/954,534

(22) Filed: Nov. 30, 2015

(65) Prior Publication Data

US 2016/0083218 A1 Mar. 24, 2016

Related U.S. Application Data

(63) Continuation of application No. PCT/FI2013/050621, filed on Jun. 7, 2013.

(51) Int. Cl.

| | |
|---|---|
| ***B66B 1/34*** | (2006.01) |
| ***B66B 1/24*** | (2006.01) |
| ***B66B 3/00*** | (2006.01) |
| ***B66B 1/28*** | (2006.01) |

(52) U.S. Cl.

CPC ..... *B66B 1/2458* (2013.01); *B66B 1/28* (2013.01); *B66B 1/3446* (2013.01); *B66B 3/006* (2013.01)

(58) Field of Classification Search

CPC ..... B66B 1/2458; B66B 1/28; B66B 1/3445; B66B 3/006; B66B 1/3446

USPC ..... 187/247, 380–388, 391–393, 396, 901

See application file for complete search history.

(56) References Cited

U.S. PATENT DOCUMENTS

| | | | | |
|---|---|---|---|---|
| 5,487,451 | A * | 1/1996 | Hughes | B66B 1/18 187/392 |
| 6,360,849 | B1 | 3/2002 | Hikita | |
| 7,328,775 | B2 * | 2/2008 | Zaharia | B66B 1/18 187/391 |
| 7,712,586 | B2 * | 5/2010 | Legez | B66B 1/20 187/387 |
| 7,987,947 | B2 * | 8/2011 | Christy | B66B 1/468 187/249 |

(Continued)

FOREIGN PATENT DOCUMENTS

| | | |
|---|---|---|
| CN | 1283581 A | 2/2001 |
| CN | 101351396 A | 1/2009 |

(Continued)

*Primary Examiner* — Anthony Salata

(74) *Attorney, Agent, or Firm* — Birch, Stewart, Kolasch & Birch, LLP

(57) ABSTRACT

The invention relates to a method in allocation of an elevator for a passenger of an elevator system, including a step of allocating an elevator for a passenger in a lobby of the elevator system, and thereafter a step of signaling the allocated elevator to the passenger before the arrival of the car of the allocated elevator at said lobby. The method includes the steps of obtaining traffic data describing traffic in said elevator lobby, and determining the signaling moment based on said traffic data, and thereafter signaling the allocated elevator to the passenger at the determined moment. The invention relates also to an elevator system implementing the method.

28 Claims, 1 Drawing Sheet

(56) References Cited

U.S. PATENT DOCUMENTS

| | | | | |
|---|---|---|---|---|
| 8,020,672 | B2 * | 9/2011 | Lin | B66B 1/34 187/316 |
| 8,573,366 | B2 * | 11/2013 | Elomaa | B66B 1/2458 187/387 |
| 8,950,555 | B2 * | 2/2015 | Brand | B66B 1/2458 187/382 |
| 9,079,751 | B2 * | 7/2015 | Sundholm | B66B 1/2458 |
| 9,278,828 | B2 * | 3/2016 | Eto | B66B 1/2458 |
| 9,365,392 | B2 * | 6/2016 | Jacobs | B66B 1/2466 |
| 9,463,953 | B2 * | 10/2016 | Lee | B66B 1/3476 |
| 9,481,548 | B2 * | 11/2016 | Siddiqui | B66B 1/2416 |
| 2002/0033306 | A1 | 3/2002 | Kostka et al. | |
| 2008/0289910 | A1 | 11/2008 | Christy et al. | |
| 2011/0155515 | A1 | 6/2011 | Suzuki et al. | |
| 2016/0376122 | A1 * | 12/2016 | Van Dijk | B66B 1/2466 187/247 |

FOREIGN PATENT DOCUMENTS

| | | | |
|---|---|---|---|
| CN | 101456502 | A | 6/2009 |
| CN | 101959784 | A | 1/2011 |
| CN | 102159482 | A | 8/2011 |
| EP | 2277816 | A1 | 1/2011 |
| JP | 2012-180160 | A | 9/2012 |
| WO | WO 2007/084459 | A2 | 7/2007 |
| WO | WO 2007/147927 | A1 | 12/2007 |
| WO | WO 2008/116963 | A1 | 10/2008 |
| WO | WO 2011/012768 | A1 | 2/2011 |

* cited by examiner

SIGNALING ELEVATOR ALLOCATION BASED ON TRAFFIC DATA

CROSS-REFERENCE TO RELATED APPLICATIONS

This application is a Continuation of PCT/FI2013/050621, filed on Jun. 7, 2013, all of which are hereby expressly incorporated by reference into the present application.

FIELD OF THE INVENTION

The invention relates to allocation of an elevator in an elevator system, wherein the elevator system comprises elevators suitable for transporting passengers.

BACKGROUND OF THE INVENTION

In modern elevator systems having plural elevators, the elevator traffic is managed by a group control, which controls a plurality of elevators. The group control responds to calls from the passengers and determines with an allocation process which elevator is in each case optimal to be sent to serve the passenger. The call may be for instance a conventional up or down-type call, which includes the information of the direction where the passenger intends to travel. In the more moderns systems the call may be a destination call, which includes the destination information of the passenger. In the latter case, the group control implements so-called destination control system, in which each elevator user gives his/her personal destination information to the elevator system in the elevator lobby before boarding the elevator car. This is typically implemented with a destination call panel placed in the lobby of the elevator system. In a system using destination control, the destination information is the only necessary input from the passenger. After receiving the call including the destination information, i.e. the destination call, the system allocates an elevator for the passenger based on certain logic. After allocation, the elevator system schedules the allocated elevator to stop at the lobby of the passenger. At a suitable moment after the allocation, the system gives the passenger a signal identifying which one of the elevators has been allocated to him. Thereby, the passenger can start proceeding towards the door of the elevator in question. In prior art the signaling moment is usually immediately after the allocation. The immediate signaling is used in cases where the allocation process is started and finalized immediately after the call. This type of allocation process is known as immediate landing call allocation (ILA). The drawback of ILA is that any changes in call situation occurring after the end of the allocation process cannot be taken into account any more. In prior art, also such a solution is known where the signaling is not performed immediately after the allocation. In this solution the result of the allocation is not finalized nor signaled to the passenger until at the latest possible moment before the arrival of the car of the allocated elevator at the lobby where the passenger is. In this way the allocation process can be continued longer. This makes it possible that the allocation can be repeated after the initial allocation, and should the call situation change, the allocation can be changed too. Thereby, the system can take into account late changes in the call situation and optimize the operation of the elevators accordingly. The drawback of this system is that the passenger has to walk to the door of the elevator allocated for him/her in haste. In prior art, if such problems has been noticed in a certain elevator system, the system is reprogrammed such that the signaling takes place always before a fixed period of time before the arrival of the allocated car to the lobby.

BRIEF DESCRIPTION OF THE INVENTION

The object of the invention is, inter alia, to solve one or more of the previously described drawbacks of known solutions and problems discussed later in the description of the invention. An object of the invention is, in particular, to provide an elevator system with further improved method in allocation. Embodiments are presented, which, inter alia, facilitate improving the overall efficiency of the elevator system. In particular, embodiments are presented, which, inter alia, facilitate finding an optimal balance between the time used for allocating and the time used for loading the elevator car after it has arrived at the landing.

It is brought forward a new method in allocation of an elevator for a passenger of an elevator system, comprising a step of allocating an elevator for a passenger in a lobby of the elevator system, and thereafter a step of signaling the allocated elevator to the passenger before the arrival of the car of the allocated elevator at said lobby. The method comprises the steps of obtaining traffic data describing traffic in said elevator lobby, and determining the signaling moment based on said traffic data, and thereafter said signaling wherein the allocated elevator is signaled to the passenger at the determined moment. Thereby, the method takes into account the traffic in the lobby and the passenger can be given adequately time to proceed to the proximity of the elevator allocated to him/her. Taking the traffic into account can also facilitate finding of an optimal balance between the time used for allocating and the time used for loading the elevator car after it has arrived at the landing. Then, the overall efficiency of the elevator system can be improved, because the elevator car can be loaded quickly. For instance, the passenger can be timed to arrive at the proximity of the elevator door right after the car of the allocated elevator has arrived at the lobby. This gives also the possibility to shorten the duration of the stop.

In a preferred embodiment said step of obtaining traffic data comprises generating traffic data describing traffic in said elevator lobby. Thus, the traffic data can be obtained. When the generation of the traffic data is carried out in the method, it can be relied on. It is also possible to refresh the traffic data by generating it repeatedly so it describes current or at least closely recent traffic situation. Preferably, said step of generating traffic data comprises sensing traffic in the lobby by sensing means such as sensor(s) and/or camera(s). Thus, the traffic data can be generated based on real traffic situation. Preferably, said step of generating traffic data comprises sensing traffic in the lobby, and deriving said traffic data from the raw data generated by said sensing. Most sensing means produce raw data, which need to be processed so as to arrive at a data, e.g. a value, describing the traffic. Said deriving may include data processing well known in the art of traffic sensing, such as in the art of people counting.

In a preferred embodiment said traffic data indicates at least the amount of traffic in said lobby. This is the most useful piece of information related to traffic. It can also be derived easily, for example by counting from raw data (generated by sensing the traffic) by a program run on a microprocessor of the elevator control.

In a preferred embodiment said traffic data expresses the amount of traffic in the lobby as a value, such as a reference value.

In a preferred embodiment in determining the signaling moment based on said traffic data, the signaling moment is determined to be placed in time earlier after the allocation of an elevator for the passenger if high traffic is indicated than if low traffic is indicated by said traffic data.

In a preferred embodiment the signaling moment is determined dynamically based on the traffic data. In particular, it is preferable that the signaling moment is placed in time a nonfixed time period after the allocation of an elevator for the passenger and a nonfixed time period before the arrival of the car of the allocated elevator at said lobby.

In a preferred embodiment the step of determining the signaling moment comprises determining a signaling time period, and the step of signaling the allocated elevator to the passenger comprises identifying the allocated elevator to the passenger said signaling time period before the arrival of the car of the allocated elevator at the lobby. In this way, this time period is the time the passenger is given for moving to the proximity of the elevator he/she has been allocated. In this way, this time can be easily controlled to match the needs caused by the momentary traffic.

In a preferred embodiment the method comprises before said step of allocating a step of receiving a call from the passenger. This call may be for instance a conventional up or down-type call, which includes the information of the direction where the passenger intends to travel, or it may be a destination call. In a preferred embodiment this call is a destination call from the passenger. Said destination call is preferably a wireless destination call signal, if it is sent from a portable device of the passenger, such as a mobile phone or a tablet.

In a preferred embodiment the method comprises before said step of signaling a step of allocating an elevator for the passenger for the first time and a step of allocating an elevator for the passenger for the second time. Thus, the allocating is repeated, preferably as many times as there is time for. This makes it possible to change the allocation if the call situation changes.

In a preferred embodiment the method comprises before said signaling a sequence of obtaining traffic data describing traffic in the elevator lobby and thereafter determining the signaling moment based on the traffic data for the first time, and a second sequence of obtaining traffic data describing traffic in the elevator lobby and thereafter determining the signaling moment based on the traffic data for the second time. Thus, the traffic data can be refreshed, which may be advantageous if the signaling moment is placed in time a long period after the traffic data was previously obtained.

In a preferred embodiment the method comprises a step of identifying condition of the passenger, in particular if the passenger is using a moving aid, such as a wheel chair or a walking stick or a walker, and determining the signaling moment based on the condition of the passenger. In this way the special needs of the passenger, which affect the time he/she needs, can be taken into account. The identification of the condition can be performed either by a program processing the aforementioned raw data generated by the sensing means or alternatively the identification can received from the passenger himself/herself as a part of the call received from him/her.

In a preferred embodiment the signaling moment is determined to be earlier if the passenger is identified to be using a moving aid than if the passenger is identified not to be using a moving aid.

In a preferred embodiment the signaling moment is determined to be immediately after the allocation if the passenger is identified to be using a moving aid.

In a preferred embodiment the step of signaling the allocated elevator to the passenger at the determined moment comprises sending a signal identifying the allocated elevator to a signaling means provided with means for identifying the allocated elevator to the passenger. The signaling means may be, for instance in the form of arrow indicators adjacent the doors of the elevators, or it may comprise a display on which an information identifying the allocated elevator is showed to the passenger.

In a preferred embodiment the step of signaling the allocated elevator to the passenger at the determined moment comprises sending a signal identifying the allocated elevator to a signaling means provided with means for showing information identifying the allocated elevator to the passenger. Preferably, said means means for showing comprises a display on which an information identifying the allocated elevator is showed to the passenger.

In a preferred embodiment said signaling means is a portable device, such as a mobile phone or a tablet.

In a preferred embodiment the step of signaling the allocated elevator to the passenger at the determined moment comprises showing information identifying the allocated elevator on a display to the passenger. This information is preferably a label, a code or a name given for the elevator in question. A sign with a corresponding label, code or name is provided at the immediate proximity of the elevator in question (such as adjacent the door thereof), so the allocated elevator can be found easily.

It is also brought forward a new elevator system, comprising a plurality of elevators, an elevator control, a lobby and a signaling means, wherein the elevator control is configured to allocate an elevator for a passenger in response to a call received from the passenger, and to signal the allocated elevator to the passenger before the arrival of the car of the allocated elevator at said lobby. The elevator control is configured to obtain traffic data describing traffic in said elevator lobby, and to determine a signaling moment based on said traffic data and thereafter to signal the allocated elevator to the passenger at the determined signaling moment with said signaling means.

In a preferred embodiment the elevator system comprises means for generating traffic data describing traffic in said elevator lobby.

In a preferred embodiment said means for generating traffic data describing traffic in said elevator lobby comprises sensing means, such as sensor(s) and/or camera(s).

In a preferred embodiment said signaling means comprises means for showing information identifying the allocated elevator to the passenger. Preferably, said signaling means comprises a display on which the information identifying the allocated elevator to the passenger is configured to be showed.

In a preferred embodiment said signaling means is a portable device, such as a mobile phone or a tablet.

The elevators of the elevator system as described anywhere above is preferably, but not necessarily, installed inside a building, most preferably inside a tower building. Each elevator is preferably arranged to serve two or more lobbies placed at different altitudes and along the path of the elevator car. Preferably, each of the elevators of the elevator system comprises a car has with an interior space suitable for receiving a passenger or passengers.

BRIEF DESCRIPTION OF THE DRAWINGS

In the following, the present invention will be described in more detail by way of example and with reference to the attached drawings, in which.

DETAILED DESCRIPTION

Figure 1:
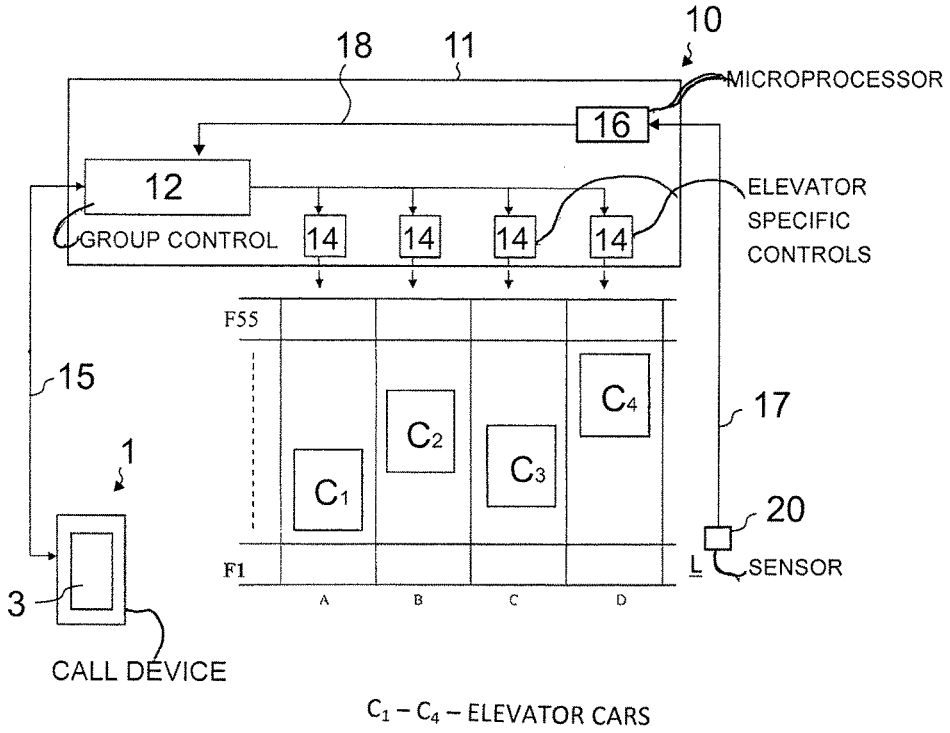
FIG. 1 illustrates an elevator system according to a preferred embodiment, which elevator system implements a method according to the invention.
Figure 2:
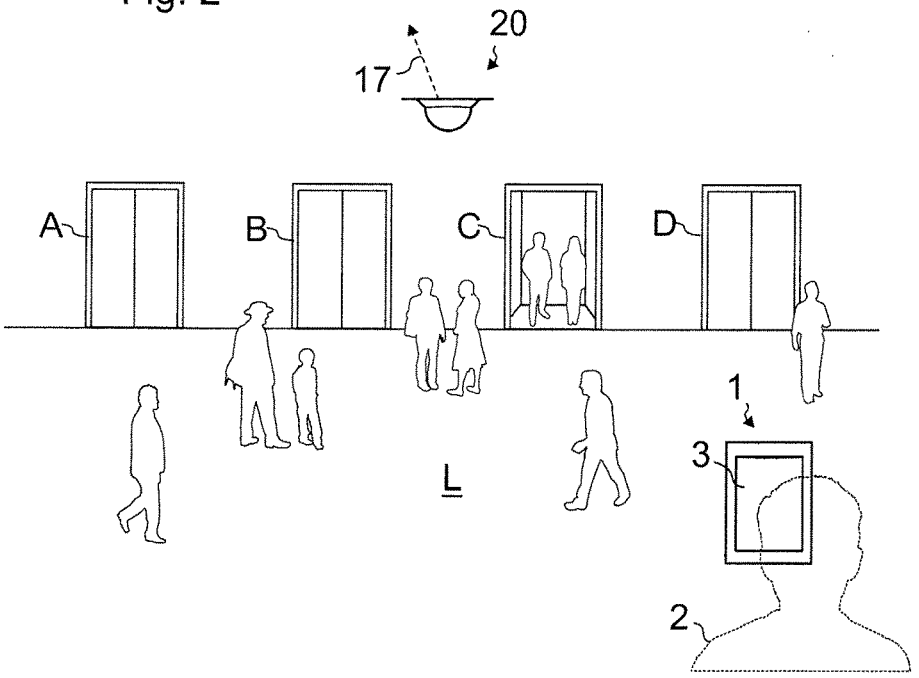
FIG. 2 illustrates three dimensionally the elevator lobby of FIG. 1.

FIG. 1 illustrates an elevator system 10 according to a preferred embodiment. The elevator system comprises plurality of elevators, in this case four elevators A, B, C and D, as well as an elevator control 11. The elevator control 11 is configured to control elevators A-D, in particular the operation of the elevator cars $C_1$, $C_2$ , $C_3$ and $C_4$ thereof, in response to calls it receives from a call device 1. The calls are in the preferred embodiment destination calls, the call device 1 being a destination call device. For the purpose of carrying out the actual allocation process, the elevator control 11 comprises a group control 12. In this process, the group control allocates one of the elevators A-D to the passenger 2 following a specific logic, such as an algorithm taking into account several rules and criteria, programmed on a programmable microprocessor comprised in the group control 12. Group controls of this kind are known as such. The elevator system further comprises elevator-specific controls 14, each controlling an elevator belonging to said plurality of elevators A-D according to instructions they receive from the group control. These instructions follow a schedule obtained in an allocation process performed by the group control. The elevators A-D serve in this case floors 1-55(F1-F55) in a building. The call device 1 (here destination call device 1) is connected to the elevator control via a data transfer bus 15, which may be wireless or wired depending on the type of the call device 1. The call device 1 is in the preferred embodiment in the form of a panel, as illustrated, and fixed to the lobby L to be used by all the passengers. Alternatively, it may be a personal device carried by the passenger, such as a mobile phone or a tablet. FIG. 2 illustrates the lobby L of the elevator system 1.

In the method according to the preferred embodiment, the elevator system, in particular the elevator control 11, receives the call, which is in this case a destination call, from the passenger 2. As a response to this call, the elevator system 1, in particular the group control 12 of the elevator control 11, allocates an elevator A, B, C or D for the passenger 2 in the lobby L of the elevator system 1, and thereafter signals the allocated elevator to the passenger 2 before the arrival of the car $C_1$, $C_2$ , $C_3$ or $C_4$ of the allocated elevator A, B, C or D at the lobby L. The method takes into account the traffic in the lobby L. For this purpose it comprises before said signaling the step of obtaining traffic data describing traffic in said elevator lobby L, and subsequently a step of determining a signaling moment based on said traffic data. Said signaling the allocated elevator A, B, C or D to the passenger 2 is performed at the determined moment. The traffic data used in determination of the signaling moment is preferably fresh. Therefore the step of obtaining traffic data is preferably carried out after said receiving of the destination call. Thus, the signaling moment can be determined based on fresh traffic data, which facilitates optimization of elevator traffic in rapidly changing traffic situations.

The step of obtaining traffic data comprises a step of generating traffic data describing traffic in said elevator lobby L. Preferably, said generating comprises sensing traffic in the lobby L by sensing means 20 such as sensor(s) and/or camera(s) placed in the lobby L. There are commercially available sensors and cameras suitable for this purpose. The traffic data is derived from the raw data generated by said sensing. There are commercially available programs suitable for this purpose. For instance, in case the sensing means is in the form of camera(s) the raw data may be in the form of images and the traffic data can be derived from the images with an image recognition program. Alternatively, in case the sensing means 20 is in the form of sensor(s), for instance proximity sensors, the raw data may be in the form of electrical signals and the traffic data can be derived from the signals with a computer program. The elevator control 11 may comprise a programmable microprocessor unit 16 for the purpose of deriving traffic data from the raw data, which microprocessor unit 16 is arranged to receive the raw data from the sensing means 20 via a data transfer bus 17. Alternatively, the traffic data can be derived by a programmable microprocessor unit which functions independently of the elevator control 11. The microprocessor unit 16 may be connected to the group control 12 with a data transfer bus 18, in which group control 12 the step of obtaining traffic data describing traffic in said elevator lobby L, and the step of determining the signaling moment based on said traffic data, and the step of signaling are performed.

Said traffic data preferably indicates at least the amount of traffic in said lobby L at the moment of said sensing. The amount of traffic data is preferably expressed with a value, in particular, it may be in the form of a reference value. At simplest, the value is directly proportional to the number of people positioned within a predetermined zone of the lobby L. The elevator control 11, for example the group control 12 thereof, comprises a programmable microprocessor unit, which is programmed to determine a suitable signaling moment based on the traffic data. Preferably, the step of determining the signaling moment comprises a step of determining a signaling time period, and the signaling the allocated elevator to the passenger 2 comprises a step of signaling the allocated elevator to the passenger 2 said signaling time period before the arrival of the car of the allocated elevator at said lobby of said passenger 2. This can be implemented such that the programmable microprocessor unit associates said value with a signaling time period. The program may for instance pick a signaling time period from a table associating different values with different signaling time periods.

The signaling moment is determined dynamically based on the traffic data. Dynamical determination means that the signaling moment is not fixed. Thus, the signaling does not take place for all of its stops/runs at the same moment before arrival of the car. Most preferably, the signaling moment is placed in time a nonfixed time period after the allocation of an elevator for the passenger 2 and a nonfixed time period before the arrival of the car $C_1$, $C_2$ , $C_3$ or $C_4$ of the allocated elevator A, B, C or D at the lobby L. Most preferably, the signaling moment is determined to be placed in time earlier after the allocation if high (=high amount of) traffic is indicated than if low (=low amount of) traffic is indicated by said traffic data. Thereby, the passenger has enough time to move to the proximity of his/her elevator also when the traffic is high.

The elevator control 11 can run the allocation process all the time between the moment when the call (here a destination call) has been received and the signaling moment. For instance, if the signaling moment can be determined to be late after the destination call has been received, the elevator control 11 has time to perform before said signaling a step of allocating an elevator for the passenger for the first time and a step of allocating an elevator for the passenger for the second time. This is beneficial especially if the system receives further destination calls after the allocation has been finalized for the first time. The second allocating step can provide further optimized management of elevator use as it can work better informed, and if sometimes to allocate a different elevator than what was allocated in the first allocation.

It is also possible to refresh the traffic data, which may be advantageous if the signaling moment is placed in time a long period after the traffic data was obtained. If refreshing the traffic data is desired, the method comprises before said signaling a sequence of obtaining traffic data describing traffic in the elevator lobby and thereafter determining the signaling moment based on the traffic data for the first time, and a second sequence of obtaining traffic data describing traffic in the elevator lobby and thereafter determining the signaling moment based on the traffic data for the second time. However, this is not necessary, especially if the traffic situation does not tend to change rapidly in the elevator system in question.

In the preferred embodiment, the aforementioned step of signaling the allocated elevator (A, B, C or D) to the passenger at the determined moment comprises showing information identifying the allocated elevator on a display 3 to the passenger 2. More specifically, the step of signaling the allocated elevator to the passenger 2 at the determined moment comprises sending at the determined moment a signal identifying the allocated elevator (A, B, C or D) to a signaling means 1 provided with means 3 for showing information identifying the allocated elevator to the passenger 2. This signaling means is preferably, but not necessarily, the same means as the aforementioned call means 1. As described earlier above, the destination call means 1 may be in the form of a panel fixed to the lobby to be used by all the passengers or alternatively a personal portable device carried by the passenger, such as a mobile phone or a tablet. In any case, it is preferable that said signaling means 1 comprises a display 3 on which the information identifying the allocated elevator (A, B, C or D) to the passenger 2 is showed. The signaling means 1 is advantageously a portable device, because in this way the person need not wait for the signal at a certain location. In case the signaling means 1 is a portable device, the signal identifying the allocated elevator (A, B, C or D) is sent wirelessly to the signaling means 1 in form of a portable device 1.

In addition to the traffic data, the signaling moment may optionally be determined also based on the condition of the passenger. In that case, the method comprises a step of identifying the passenger condition, in particular if the passenger is using a moving aid, such as a wheel chair or a walking stick or a walker, and determining the signaling moment based on the passenger condition. The signaling moment is in this case determined to be earlier if the passenger is identified to be using a moving aid than if the passenger is identified not to be using a moving aid. It is preferable, that if the passenger is identified to be using a walking aid, the signaling moment is determined to be immediately after the allocation.

The elevator system 10 has been described already above. It is more specifically such that it comprises a plurality of elevators A, B, C and D, an elevator control 11, a lobby L and a signaling means 1, wherein the elevator control 11 is a control means which is configured to allocate an elevator A, B, C or D for a passenger in response to a call received from the passenger, and to signal the allocated elevator A, B, C or D to the passenger before the arrival of the car $C_1$, C2, C3 or C4 of the allocated elevator A, B, C or D at said lobby L. The elevator control 11 is configured to obtain traffic data describing traffic in said elevator lobby L, and to determine a signaling moment based on said traffic data and thereafter to signal the allocated elevator A, B, C or D to the passenger 2 at the determined signaling moment with said signaling means 1.

For carrying out the steps mentioned above, the elevator control comprises programmable microprocessor unit(s) 12, 16. The elevator system comprises a means 20, 16 for generating traffic data describing traffic in said elevator lobby L. These means 20, 16 for generating traffic data describing traffic in said elevator lobby L comprise sensing means 20 such as sensor(s) and/or camera(s) as well as means 16 for deriving said traffic data from the raw data generated by said sensing means 20. There are numerous different means for sensing traffic available commercially.

Said means 16 for deriving said traffic data from the raw data generated by said sensing means 20 preferably is in the form of a programmable microprocessor unit 16 arranged to receive the raw data from the sensing means 20 via a data transfer bus 17 as illustrated in FIG. 1.

The signaling means 1 comprises means 3 for showing information identifying the allocated elevator to the passenger 2. The signaling means 1 preferably comprises a display 3 on which the information identifying the allocated elevator A, B, C or D to the passenger 2 is configured to be showed. The signaling means 1 is preferably in the form of a portable device, such as a mobile phone or a tablet.

The elevator system further comprises a call means 1 (here destination call means) via which the passenger 2 can give a call (here a destination call). These call means 1 is connected to the elevator control via a data transfer bus 15, which may be wireless or wired depending on the type of the destination call device 1. The connection, of course may be temporary, which is preferred especially in case the call means 1 is in the form of a personal device.

In the method according to the preferred embodiment, the elevator system, in particular the elevator control 11, is configured to receive a call, in this case a destination call, from the passenger 2 via the call means 1 (here destination call means). The call means 1 is preferably, but not necessarily, the same means as the aforementioned signaling means 1. Thus, the passenger 2 can be signaled the allocated elevator via the same means that he/she used for giving the call to the elevator system 10.

The elevator control and its microprocessor units may be located in distant locations, or alternatively in their immediate proximity. It is to be understood that it is not necessary that there is a separate microprocessor unit for each step. The steps described above can be configured to be performed either in a single microprocessor unit (of the elevator control 11) or in several microprocessor units (of the elevator control 11) communicating with each other.

Preferably said generating the traffic data comprises directly sensing traffic in the lobby L by sensing means 20. However, said generating the traffic data could alternatively involve generating the traffic data by deducing the data describing the traffic in the lobby, such as data indicating the amount of people in the lobby, indirectly from access control data of the building, elevator access control data, car load weighing data or any other data which is available and usable for deducing the traffic data.

In the above, a preferred embodiment has been described where the calls are destination calls received from a destination call device 1. The invention can, however, be utilized also in elevator systems where the calls are up or down-type of calls, the call including the information of the direction where the passenger intends to travel. In that case, the call device could be a button arrangement mounted in the lobby L, such as a conventional up/down-button arrangement. In that case, the signaling means 1 provided with means 3 for identifying the allocated elevator to the passenger 2 would preferably be in the form of arrow indicators adjacent the doors of the elevators. Then the signaling step would involve activating an arrow indicator adjacent the allocated elevator at the signaling moment.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. A method of allocation of an elevator for a passenger of an elevator system, comprising a step of allocating an elevator for a passenger in a lobby of the elevator system, and thereafter signaling the allocated elevator to the passenger before the arrival of the car of the allocated elevator at said lobby, wherein the method comprises:

obtaining traffic data describing traffic in said elevator lobby, and determining the signaling moment based on said traffic data, and signaling the allocated elevator to the passenger at the determined signaling moment.

2. A method according to claim 1, wherein said step of obtaining traffic data comprises generating traffic data describing traffic in said elevator lobby.

3. A method according to claim 1, wherein said step of generating traffic data comprises sensing traffic in the lobby by sensing means such as a sensor or a camera.

4. A method according to claim 1, wherein said step of generating traffic data comprises sensing traffic in the lobby, and deriving said traffic data from the raw data generated by said sensing.

5. A method according to claim 1, wherein said traffic data indicates at least the amount of traffic in said lobby.

6. A method according to claim 1, wherein said traffic data expresses the amount of traffic in the lobby as a value, such as a reference value.

7. A method according to claim 1, wherein in determining the signaling moment based on said traffic data, the signaling moment is determined to be earlier after the allocation if high traffic is indicated than if low traffic is indicated by said traffic data.

8. A method according to claim 1, wherein the signaling moment is determined dynamically based on the traffic data.

9. A method according to claim 1, wherein the signaling moment is placed in time a nonfixed time period after the allocation of an elevator for the passenger and a nonfixed time period before the arrival of the car of the allocated elevator at said lobby.

10. A method according to claim 1, wherein the step of determining the signaling moment comprises determining a signaling time period, and the step of signaling the allocated elevator to the passenger comprises identifying the allocated elevator to the passenger said signaling time period before the arrival of the car of the allocated elevator at the lobby.

11. A method according to claim 1, wherein it comprises a step of receiving a call from the passenger.

12. A method according to claim 1, wherein it comprises a step of receiving a destination call from the passenger.

13. A method according to claim 1, wherein it comprises, before said step of signaling, a step of allocating an elevator for the passenger for the first time and a step of allocating an elevator for the passenger for the second time.

14. A method according to claim 1, wherein it comprises before said signaling a sequence of obtaining traffic data describing traffic in the elevator lobby and thereafter determining the signaling moment based on the traffic data for the first time, and a second sequence of obtaining traffic data describing traffic in the elevator lobby and thereafter determining the signaling moment based on the traffic data for the second time.

15. A method according to claim 1, wherein it comprises a step of identifying condition of the passenger, in particular if the passenger is using a moving aid, such as a wheel chair or a walking stick or a walker, and determining the signaling moment based on the condition of the passenger.

16. A method according to claim 1, wherein the signaling moment is determined to be earlier if the passenger is identified to be using a moving aid than if the passenger is identified not to be using a moving aid.

17. A method according to claim 1, wherein the signaling moment is determined to be immediately after the allocation if the passenger is identified to be using a moving aid.

18. A method according to claim 1, wherein the step of signaling the allocated elevator to the passenger at the determined moment comprises sending a signal identifying the allocated elevator to a signaling means provided with means for identifying the allocated elevator to the passenger.

19. A method according to claim 1, wherein the step of signaling the allocated elevator to the passenger at the determined moment comprises sending a signal identifying the allocated elevator to a signaling means provided with means for showing information identifying the allocated elevator to the passenger.

20. A method according to claim 1, wherein said signaling means comprises a display on which an information identifying the allocated elevator is showed to the passenger.

21. A method according to claim 19, wherein said signaling means is a portable device, such as a mobile phone or a tablet.

22. A method according to claim 1, wherein the step of signaling the allocated elevator to the passenger at the determined moment comprises showing information identifying the allocated elevator on a display to the passenger.

23. An elevator system, comprising a plurality of elevators, an elevator control, a lobby and a signaling means, wherein the elevator control is configured to allocate an elevator for a passenger in response to a call received from the passenger, and to signal the allocated elevator to the passenger before the arrival of the car of the allocated elevator at said lobby, wherein the elevator control is configured to obtain traffic data describing traffic in said elevator lobby, and to determine a signaling moment based on said traffic data and thereafter to signal the allocated elevator to the passenger at the determined signaling moment with said signaling means.

24. An elevator system according to claim 23, wherein the elevator system comprises means for generating traffic data describing traffic in said elevator lobby.

25. An elevator system according to claim 23, wherein said means for generating traffic data describing traffic in said elevator lobby comprises sensing means, such as a sensor or a camera.

26. An elevator system according to claim 23, wherein said signaling means comprises means for showing information identifying the allocated elevator to the passenger.

27. An elevator system according to claim 23, wherein said signaling means comprises a display on which the information identifying the allocated elevator to the passenger is configured to be showed.

28. An elevator system according to claim 23, wherein said signaling means is a portable device, such as a mobile phone or a tablet.

* * * * *